US009664203B2

(12) United States Patent
Liu

(10) Patent No.: US 9,664,203 B2
(45) Date of Patent: May 30, 2017

(54) FAN SERIAL CONNECTION STRUCTURE

(71) Applicant: ASIA VITAL COMPONENTS (CHINA) CO., LTD., Shajing Branch, Baoan District, Shenzhen (CN)

(72) Inventor: Wen-Hao Liu, Shenzhen (TW)

(73) Assignee: ASIA VITAL COMPONENTS (CHINA) CO., LTD., Shenzhen ( * ) Notice: Subject to any disclaimer, the term of this patent is extended or adjusted under 35 U.S.C. 154(b) by 660 days.

(21) Appl. No.: 14/183,487

(22) Filed: Feb. 18, 2014

(65) Prior Publication Data

US 2015/0233392 A1 Aug. 20, 2015

(51) Int. Cl.

| | |
|---|---|
| ***F04D 29/60*** | (2006.01) |
| ***F04D 29/66*** | (2006.01) |
| ***F04D 19/00*** | (2006.01) |

(52) U.S. Cl.

CPC ..... *F04D 29/668* (2013.01); *F04D 19/007* (2013.01); *F04D 29/601* (2013.01)

(58) Field of Classification Search

CPC ..... F04D 19/007; F04D 29/601; F04D 29/668

See application file for complete search history.

(56) References Cited

U.S. PATENT DOCUMENTS

| | | | | |
|---|---|---|---|---|
| 6,865,078 | B1 * | 3/2005 | Chang | H05K 7/20727 361/690 |
| 7,522,415 | B2 * | 4/2009 | Fan | F04D 29/601 312/236 |
| 7,985,056 | B2 * | 7/2011 | Chou | F04D 19/007 361/695 |
| 8,449,251 | B2 * | 5/2013 | Lu | F04D 25/0613 415/213.1 |
| 9,404,510 | B2 * | 8/2016 | Zhu | F04D 19/007 |
| 2008/0025848 | A1 * | 1/2008 | Wu | F04D 19/007 416/244 R |
| 2008/0286100 | A1 * | 11/2008 | Hu | F04D 19/007 415/214.1 |

* cited by examiner

*Primary Examiner* — Woody Lee, Jr.

(57) ABSTRACT

A fan serial connection structure includes a series fan assembly and a connection member assembly. The series fan assembly includes a first fan frame and a second fan frame serially connected with the first fan frame. The connection member assembly includes a first connection member and a second connection member. The first connection member has a first locating section and two first side sections respectively connected with two ends of the first locating section. The second connection member has a second locating section and two second side sections respectively connected with two ends of the second locating section. The first and second locating sections are respectively assembled and connected with two opposite sides of the series fan assembly in the serial connection position. The first and second side sections are respectively assembled and connected with two other opposite sides of the series fan assembly in the serial connection position.

8 Claims, 8 Drawing Sheets

FAN SERIAL CONNECTION STRUCTURE

BACKGROUND OF THE INVENTION

1. Field of the Invention

The present invention relates generally to an improved fan serial connection structure, and more particularly to a fan serial connection structure, which can greatly reduce the vibration of the fan and lower the noise.

2. Description of the Related Art

Along with the continuous advance of sciences and technologies, the reliance of peoples on various electronic apparatuses has more and more increased. In operation, the internal components of the electronic products (such as computers and laptops) will generate high heat. The heat must be dissipated to outer side of the electronic products in time. Otherwise, the problem of overheating will take place. Therefore, most of the electronic products are provided with fans disposed therein for keeping the electronic products working at an operation temperature within a range.

Please refer to FIGS. 1A and 1B. The fan frames 10 of the current series fan 1 have the same size. The fan frames 10 are assembled with a fan impeller 11, a motor (not shown), etc. to form the fan. In operation, according to the design principle of the motor torque operation, the fan frame 11 will inevitably vibrate. Especially, with respect to a series fan, the fan frames 10 are serially connected simply by means of the latch structures 12 between the fan frames 10 along the central shaft of the fan. Therefore, the vibration state of the fan cannot be changed. As a result, when the fan impellers 11 inside the fan frames 10 operate and rotate at the same time, under the inter-affection of the vibration frequency of the fan impellers 11, the two fan frames 10 will severely resonate under resonation effect. The resonation will be directly transmitted outward form the fan frames 10. The hard disk (such as the hard disk in a server) of the mainframe system of an electronic product is quite sensitive to vibration. However, the conventional one-piece fan frame 10 can hardly reduce the vibration. In some more serious cases, the vibration of the motor and the fan impeller 11 will even interfere with the normal work of other electronic components. This will lead to deterioration of the performance of the system. Moreover, the resonation is always accompanied by loud noise.

According to the above, the conventional device has the following shortcomings:

1. The vibration of the fan can be hardly effectively reduced.
2. The vibration of the fan will make loud noise.
3. The reading efficiency of the hard disk of the system is lowered.

SUMMARY OF THE INVENTION

It is therefore a primary object of the present invention to provide an improved fan serial connection structure, which can greatly reduce the vibration of the fan.

It is a further object of the present invention to provide the above fan serial connection structure, which can greatly lower the noise caused by the vibration of the fan.

To achieve the above and other objects, the fan serial connection structure of the present invention includes a series fan assembly and a connection member assembly. The series fan assembly includes a first fan frame and a second fan frame correspondingly serially connected with the first fan frame. A first flow passage passes through the first fan frame. A second flow passage passes through the second fan frame. The second flow passage communicates with the first flow passage.

The connection member assembly includes a first connection member and a second connection member. The first connection member has a first locating section and two first side sections respectively connected with two ends of the first locating section. The second connection member has a second locating section and two second side sections respectively connected with two ends of the second locating section. The first and second locating sections are respectively assembled and connected with two opposite sides of the series fan assembly in the serial connection position. The first and second side sections are respectively assembled and connected with two other opposite sides of the series fan assembly in the serial connection position.

According to the above structural design, the first and second connection members are assembled and connected with the series fan assembly in the serial connection position. In this case, when the series fan operates, the vibration frequencies of the fans of the series fan assembly are unified to offset or damp the co-vibration of the series fan so as to greatly reduce the vibration of the series fan assembly and lower the noise caused by the vibration. In addition, the reading efficiency of the hard disk of the system is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
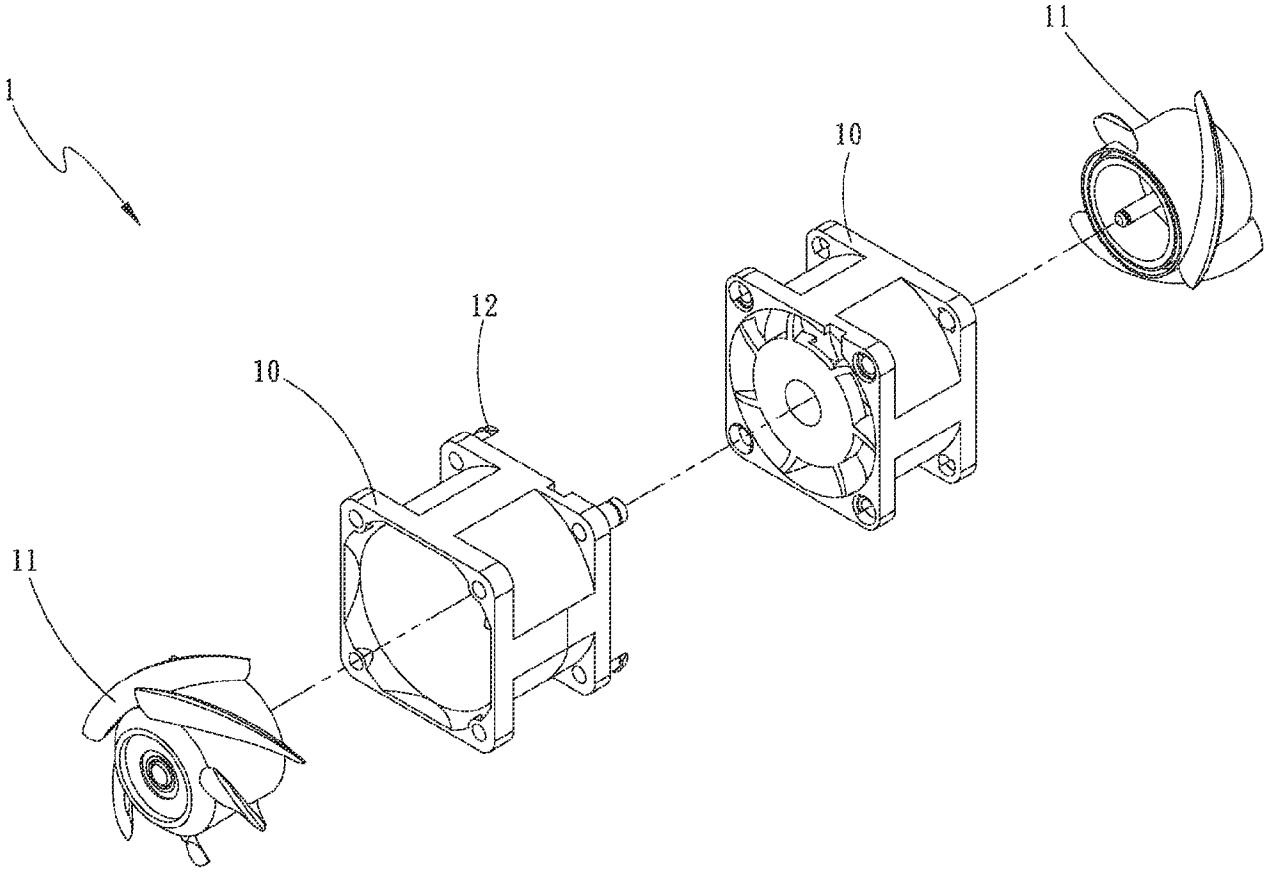
(PRIOR ART) Fig. 1A
FIG. 1A is a perspective exploded view of a conventional fan serial connection structure.
Figure 1B:
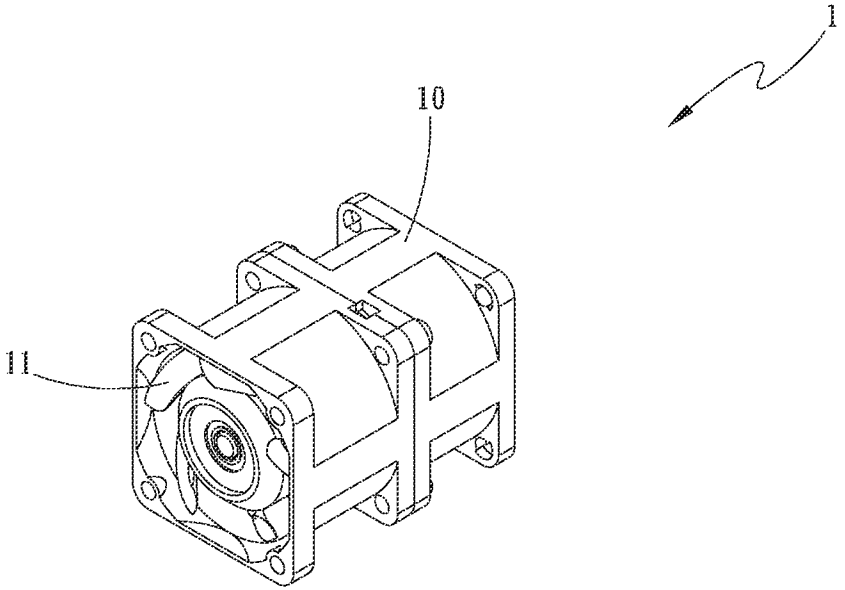
(PRIOR ART) Fig. 1B
FIG. 1B is a perspective assembled view of the conventional fan serial connection structure.
Figure 2A:
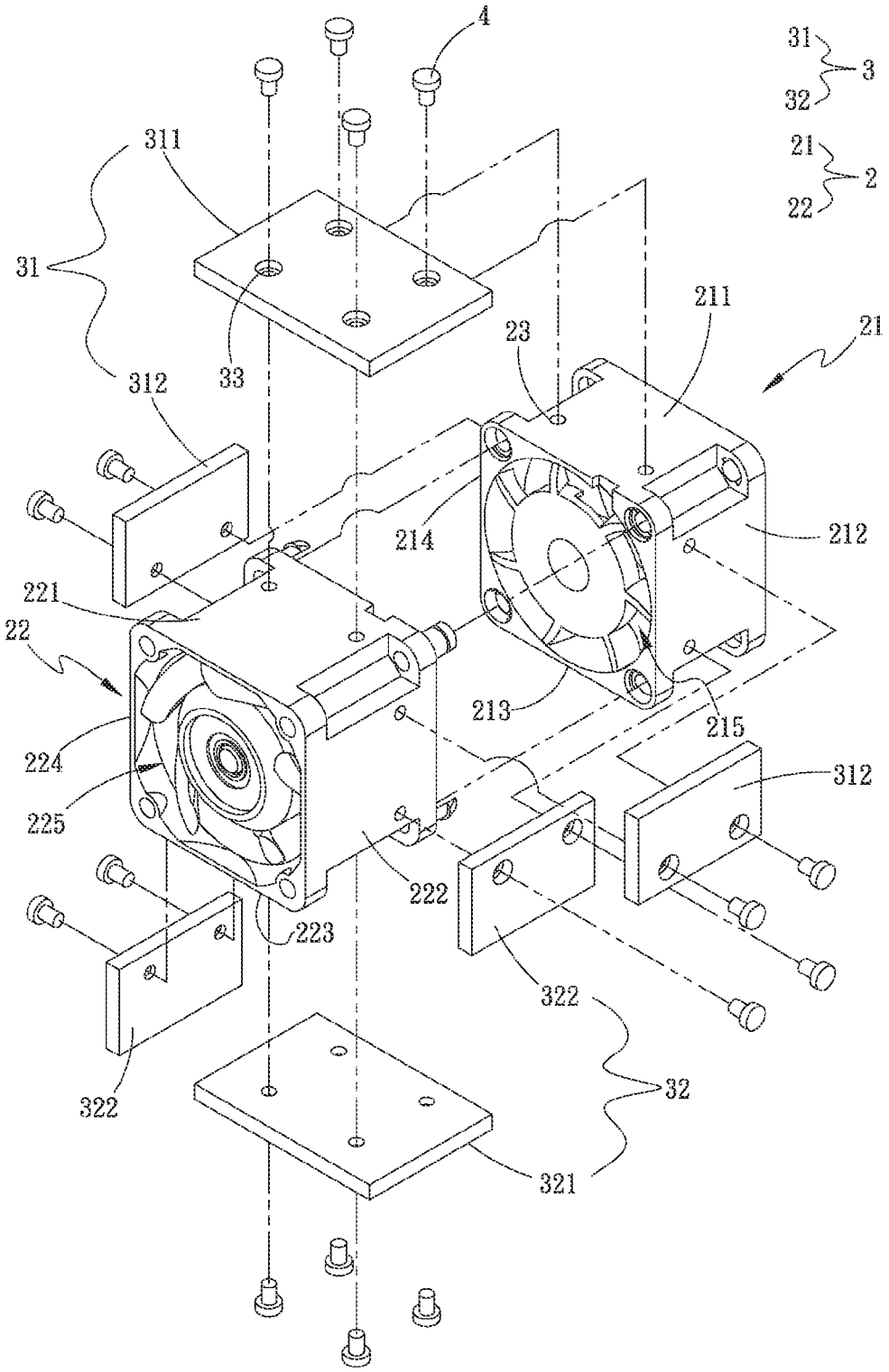
FIG. 2A is a perspective exploded view of a first embodiment of the fan serial connection structure of the present invention.
Figure 2B:
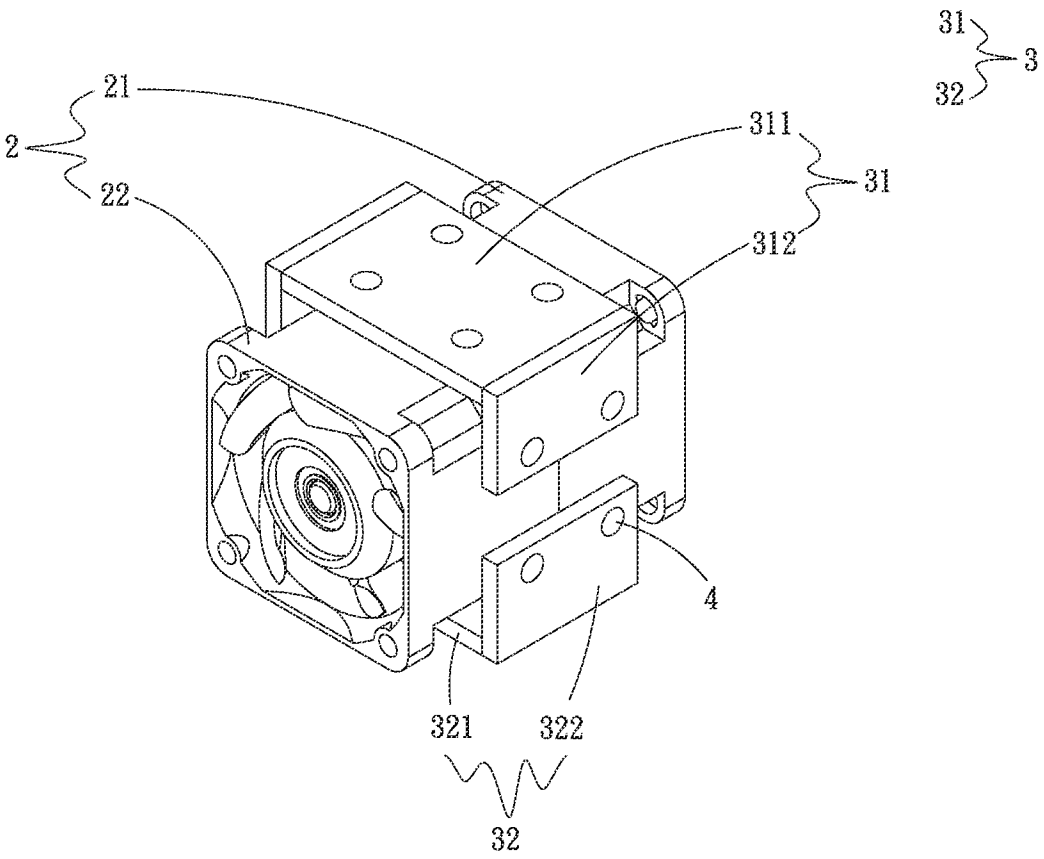
FIG. 2B is a perspective assembled view of the first embodiment of the fan serial connection structure of the present invention.

Please refer to FIGS. 2A and 2B. FIG. 2A is a perspective exploded view of a first embodiment of the fan serial connection structure of the present invention. FIG. 2B is a perspective assembled view of the first embodiment of the fan serial connection structure of the present invention. According to the first embodiment, the fan serial connection structure of the present invention includes a series fan assembly 2 and a connection member assembly 3. The series fan assembly 2 includes a first fan frame 21 and a second fan frame 22 correspondingly serially connected with the first fan frame 21. A first flow passage 215 passes through the first fan frame 21 and a second flow passage 225 passes through the second fan frame 22. The second flow passage 225 correspondingly communicates with the first flow passage 215.

In this embodiment, the first and second fan frames 21, 22 are serially connected with each other by means of, but not limited to, engagement for illustration purposes only. In practice, the first and second fan frames 21, 22 can be serially connected and assembled with each other to form the series fan assembly 2 by any other means that can securely connect the first and second fan frames 21, 22 with each other, for example, by means of locking, insertion, adhesion or latching.

The first fan frame 21 has a first side 211, a second side 212, a third side 213 opposite to the first side 211 and a fourth side 214 opposite to the second side 212. The second fan frame 22 has a fifth side 221, a sixth side 222, a seventh side 223 opposite to the fifth side 221 and an eighth side 224 opposite to the sixth side 222.

The connection member assembly 3 includes a first connection member 31 and a second connection member 32. The first connection member 31 has a first locating section 311 and two first side sections 312 respectively connected with two ends of the first locating section 311. The second connection member 32 has a second locating section 321 and two second side sections 322 respectively connected with two ends of the second locating section 321. The first and second locating sections 311, 321 are respectively assembled and connected with two opposite sides of the series fan assembly 2 in the serial connection position. The first and second side sections 312, 322 are respectively assembled and connected with two other opposite sides of the series fan assembly 2 in the serial connection position.

That is, the first locating section 311 is assembled and connected with the first side 211 of the first fan frame 21 and the fifth side 221 of the second fan frame 22 in the serial connection position, while the second locating section 321 is assembled and connected with the third side 213 of the first fan frame 21 and the seventh side 223 of the second fan frame 22 in the serial connection position. The first and second side sections 312, 322 are assembled and connected with the second and fourth sides 212, 214 of the first fan frame 21 and the sixth and eighth sides 222, 224 of the second fan frame 22 in the serial connection position.

The first and second connection members 31, 32 are formed with multiple perforations 33 and the first and second fan frames 21, 22 of the series fan assembly 2 are formed with multiple through holes 23 corresponding to the perforations 33. Multiple locking members 4 are passed through the perforations 33 and the through holes 23 to securely assemble and connect the first and second connection members 31, 32 with the series fan assembly 2. Accordingly, when the series fan operates, the vibration frequencies of the fans of the series fan assembly 2 are unified to greatly reduce the vibration and noise. Therefore, the present invention solves the problem of the conventional series fan that the first and second fan frames are simply directly assembled with each other and the vibration frequency cannot be changed. In addition, the reading efficiency of the hard disk of the system is enhanced.

Figure 3A:
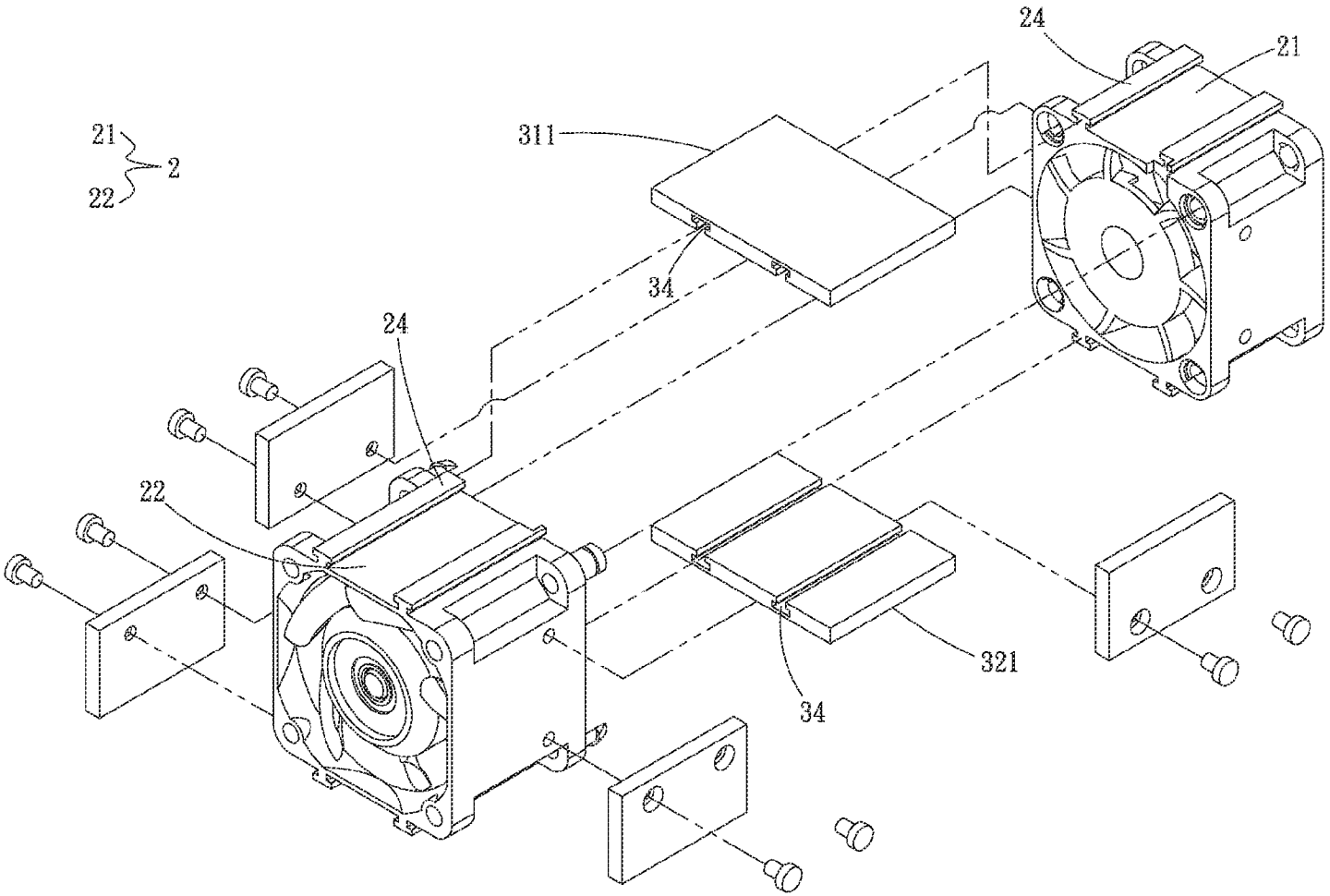
FIG. 3A is a perspective exploded view of a second embodiment of the fan serial connection structure of the present invention.
Figure 3B:
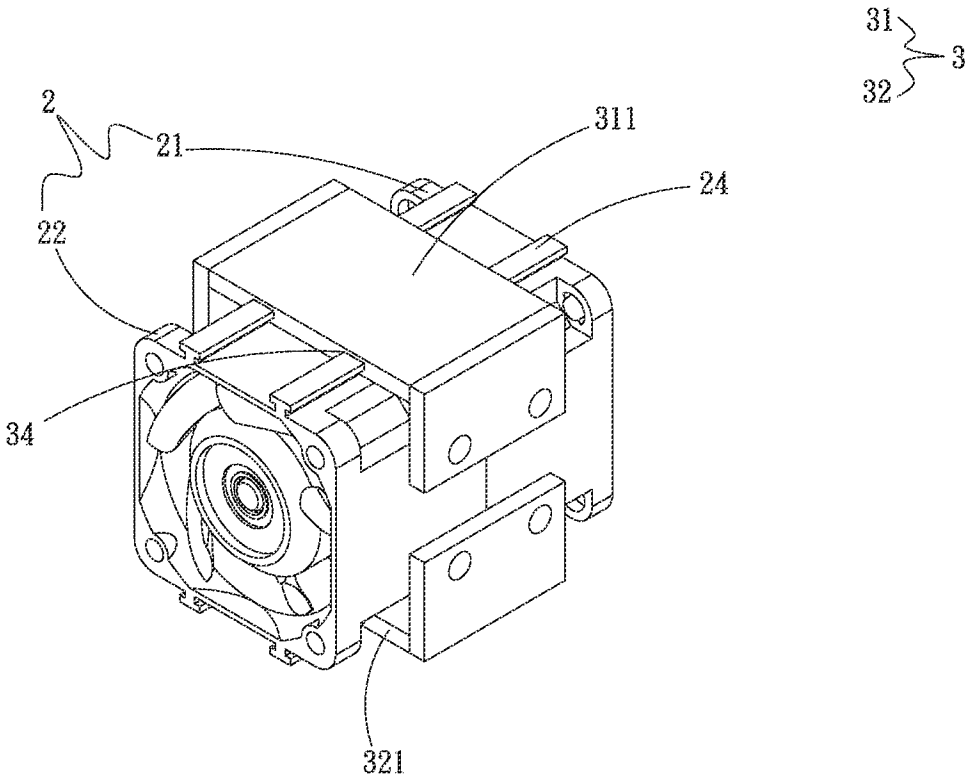
FIG. 3B is a perspective assembled view of the second embodiment of the fan serial connection structure of the present invention.

Please now refer to FIGS. 3A and 3B. FIG. 3A is a perspective exploded view of a second embodiment of the fan serial connection structure of the present invention. FIG. 3B is a perspective assembled view of the second embodiment of the fan serial connection structure of the present invention. The second embodiment is partially identical to the first embodiment in component and relationship between the components and thus will not be repeatedly described hereinafter. The second embodiment is mainly different from the first embodiment in that the first and second locating sections 311, 321 have multiple assembling sections 34. The first and second fan frames 21, 22 are formed with multiple connection sections 24 correspondingly assembled with the assembling sections 34. The assembling sections 34 can be slide rails, sockets, mortises or posts. The connection sections 24 can be slide rails, sockets, mortises or posts.

In this embodiment, the first and second fan frames 21, 22 are assembled with the first and second locating sections 311, 321 by means of, but not limited to, slide rails for illustration purposes only. In practice, the first and second fan frames 21, 22 can be assembled with the first and second locating sections 311, 321 by any other means that can securely connect the first and second fan frames 21, 22 with the first and second locating sections 311, 321, for example, by means of engagement, insertion, adhesion or latching.

According to the above structural design, the assembling sections 34 of the first and second locating sections 311, 321 are correspondingly assembled with the connection sections 24 of the first and second fan frames 21, 22 to more securely connect the connection member assembly 3 with the series fan assembly 2. In this case, when the series fan operates, the vibration frequencies of the fans of the series fan assembly 2 are unified to greatly reduce the vibration and noise of the series fan assembly 2. In addition, the reading efficiency of the hard disk of the system is enhanced.

Figure 4A:
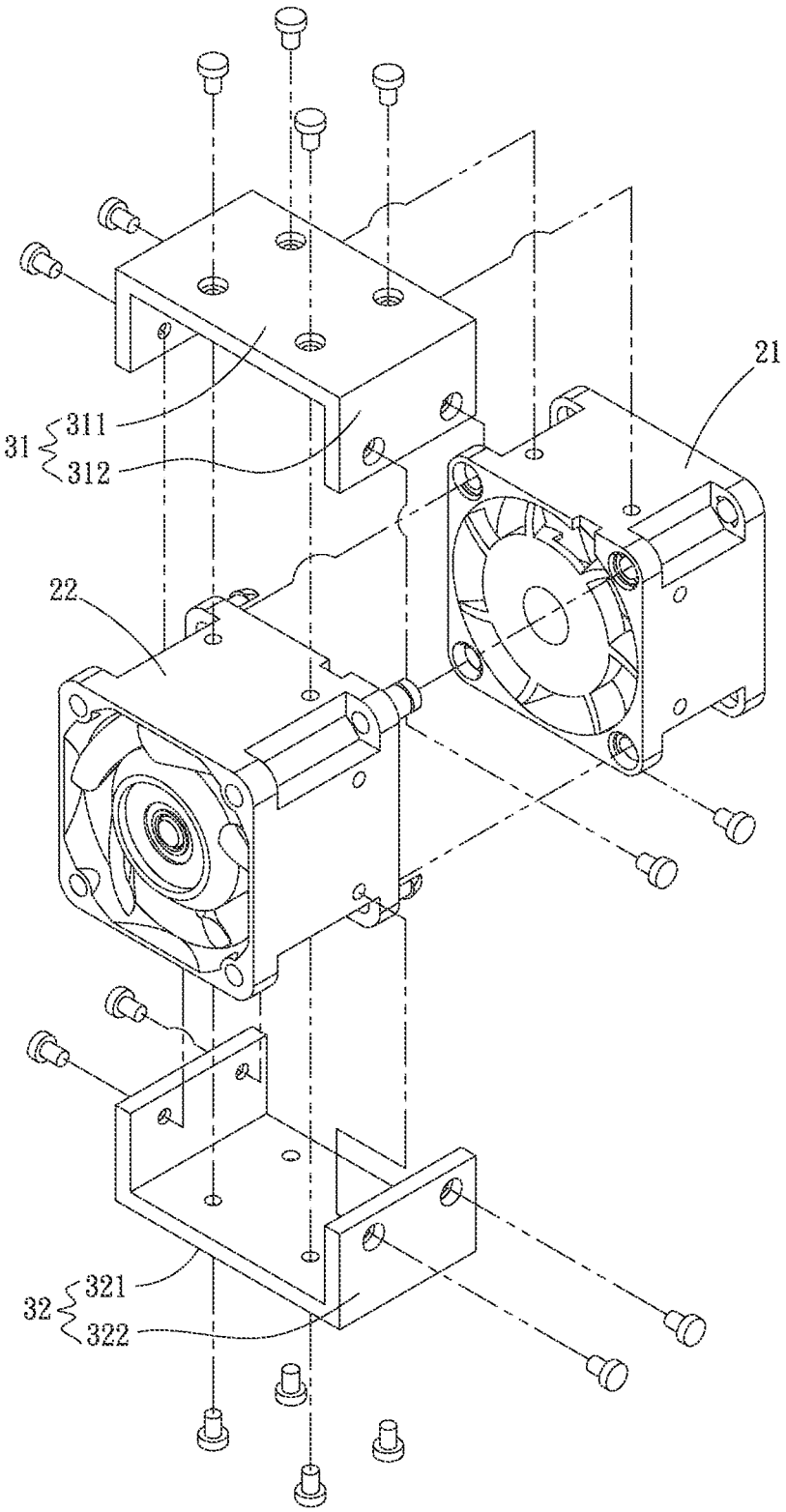
FIG. 4A is a perspective exploded view of a third embodiment of the fan serial connection structure of the present invention.
Figure 4B:
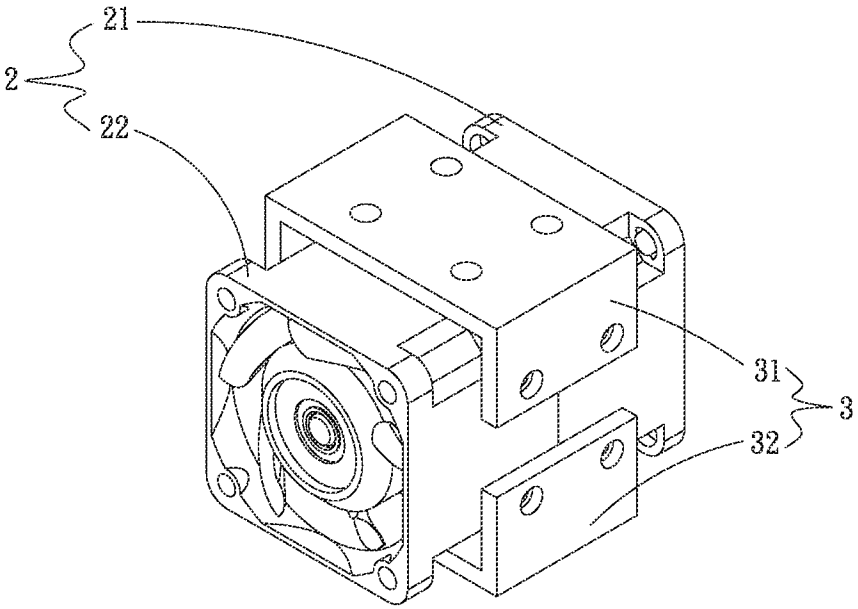
FIG. 4B is a perspective assembled view of the third embodiment of the fan serial connection structure of the present invention.

Please now refer to FIGS. 4A and 4B. FIG. 4A is a perspective exploded view of a third embodiment of the fan serial connection structure of the present invention. FIG. 4B is a perspective assembled view of the third embodiment of the fan serial connection structure of the present invention. The third embodiment is partially identical to the first embodiment in component and relationship between the components and thus will not be repeatedly described hereinafter. The third embodiment is mainly different from the first embodiment in that the first locating section 311 and the first side sections 312 of the first connection member 31 are integrally formed and the second locating section 321 and the second side sections 322 of the second connection member 32 are also integrally formed. According to such structural design, the vibration of the series fan can be also reduced and the noise caused by the vibration can be also lowered.

In conclusion, in comparison with the conventional series fan, the present invention has the following advantages:

1. The vibration of the fan is greatly reduced.
2. The noise caused by the vibration of the fan is lowered.
3. The reading efficiency of the hard disk of the system is enhanced.

The present invention has been described with the above embodiments thereof and it is understood that many changes and modifications in the above embodiments can be carried out without departing from the scope and the spirit of the invention that is intended to be limited only by the appended claims.

What is claimed is:

1. A fan serial connection structure comprising:

a series fan assembly including a first fan frame and a second fan frame correspondingly serially connected with the first fan frame, a first flow passage passing through the first fan frame, a second flow passage passing through the second fan frame, the second flow passage communicating with the first flow passage;

a connection member assembly including a first connection member and a second connection member, the first connection member having a first locating section and two first side sections respectively connected with two ends of the first locating section, the second connection member having a second locating section and two second side sections respectively connected with two ends of the second locating section, the first and second locating sections being respectively assembled and connected with two opposite sides of the series fan assembly in the serial connection position, the first and second side sections being respectively assembled and connected with two other opposite sides of the series fan assembly in the serial connection position;

wherein the first fan frame has a first side, a second side, a third side opposite to the first side and a fourth side opposite to the second side;

wherein the second fan frame has a fifth side, a sixth side, a seventh side opposite to the fifth side and an eighth side opposite to the sixth side;

wherein the first locating section is assembled and connected with the first side of the first fan frame and the fifth side of the second fan frame in the serial connection position, while the second locating section is assembled and connected with the third side of the first fan frame and the seventh side of the second fan frame in the serial connection position; and wherein the first and second side sections are assembled and connected with the second and fourth sides of the first fan frame and the sixth and eighth sides of the second fan frame in the serial connection position.

2. The fan serial connection structure as claimed in claim 1, wherein the first and second connection members are formed with multiple perforations and the series fan assembly is formed with multiple through holes corresponding to the perforations, multiple locking members being passed through the perforations and the through holes.

3. The fan serial connection structure as claimed in claim 1, wherein the first and second fan frames of the series fan assembly are serially connected with each other by means of engagement, locking, insertion, adhesion or latching.

4. The fan serial connection structure as claimed in claim 1, wherein the first and second locating sections have multiple assembling sections and the first and second fan frames are formed with multiple connection sections correspondingly assembled with the assembling sections.

5. The fan serial connection structure as claimed in claim 4, wherein the series fan assembly is assembled with the first and second locating sections by means of slide rails, engagement, locking, adhesion or latching.

6. The fan serial connection structure as claimed in claim 4, wherein the assembling sections are slide rails, sockets, mortises or posts.

7. The fan serial connection structure as claimed in claim 4, wherein the connection sections are slide rails, sockets, mortises or posts.

8. The fan serial connection structure as claimed in claim 1, wherein the first locating section and the first side sections of the first connection member are integrally formed and the second locating section and the second side sections of the second connection member are integrally formed.

* * * * *